United States Patent [19]

Rawlings

[11] 4,344,073

[45] Aug. 10, 1982

[54] FILM BREAK DETECTOR

[75] Inventor: Robert M. Rawlings, Brooklyn Park, Minn.

[73] Assignee: Padco, Inc., Minneapolis, Minn.

[21] Appl. No.: 185,275

[22] Filed: Sep. 8, 1980

[51] Int. Cl.[3] ..... G08B 21/00

[52] U.S. Cl. ..... 340/675; 226/11; 226/100; 354/321; 340/668

[58] Field of Search ..... 340/675, 668, 686; 354/321, 322, 333; 33/49; 226/11, 100

[56] References Cited

U.S. PATENT DOCUMENTS

| | | | |
|---|---|---|---|
| 1,190,053 | 7/1916 | Wescott | 340/675 |
| 2,048,182 | 7/1936 | Ybarrondo | 226/11 |
| 2,734,104 | 2/1956 | Gollhofer | 340/686 |
| 4,067,035 | 1/1978 | Plursch et al. | 354/321 |

OTHER PUBLICATIONS

Pako Corp. "Pako Cine/Strip Processors 215 Series Dryer/Take-up Section "(Ill. Parts List)", Minneapolis, 1974.

*Primary Examiner*—Glen R. Swann, III

*Attorney, Agent, or Firm*—Kinney, Lange, Braddock, Westman and Fairbairn

[57] ABSTRACT

A photographic film processor including a film dryer through which photographic film is transported under tension and dried, has a film break detection system for detecting photographic film breaks within the dryer. Upper and lower substantially horizontal shafts are positioned in the dryer in a spaced relationship. Each shaft has a plurality of spools, and the photographic film is transported back and forth over the spools and between the shafts in a serpentine fashion. The lower shaft is spatially movable with respect to the upper shaft and is biased in a direction opposite to the force on the lower shaft due to film tension. A film break within the dryer causes a loss of film tension, which in turn causes a change in the spatial position of the lower shaft. A sensor senses this change in the spatial position of the lower shaft, activates an alarm, and shuts off the dryer drive system.

10 Claims, 9 Drawing Figures

FILM BREAK DETECTOR

BACKGROUND OF THE INVENTION

1. Field of the Invention

The present invention relates to film break detection systems in photographic film processors, and in particular, it relates to break detection systems for the detection of film breaks in a photographic film dryer of a photographic film processor.

2. Description of the Prior Art

In typical commercial photoprocessing operations, individual lengths of photographic film from many customers are spliced together to form a long continuous web of photographic film. The web is then photoprocessed in a photographic film processor to develop the photographic images recorded on the film. The photographic film typically has a "wet section" where the photographic film is transported through tanks containing developer, fix, and wash solutions to permanently affix the photographic images to the film base. The processor also typically includes a dryer section which dries the photographic film immediately after it leaves the wet section. The dryer normally includes a controlled humidity chamber in which the photographic film is dried. A heated gas medium, such as air, is circulated within the dryer to dry the photographic film as it is transported under tension through the dryer section.

This manner of film developing is for the most part a continuous process where residence time in the chemical solutions of the wet section and in the dryer have been calculated for both proper development and drying of the film and for highest possible speeds in order to maximize economic efficiencies. A break in the photographic film web while being transported through the photographic processor results in a loss of time and possible damage to the images contained on the photographic film. Thus, it is of great importance to know when a film break has occurred so that corrective action can be taken to save the film from damage to splice the film, and to resume processing.

A break in the dryer section is especially costly since extensive damage to the photographic film and loss in down time can occur. If the photographic film breaks within the dryer before the film is dry, the film can collect inside the dryer and stick to itself like flypaper. The images will either be ruined or lost as the film is pulled apart. This is particularly disasterous since the damage to the film cannot be reparied, and often the scenes photographed can never be duplicated. In addition, the down time incurred is a cost in terms of the photographic film that could have been processed while the dryer is being cleared of damaged film and the film is respliced.

Prior art photographic film processors have had film break indicators, but those break indicators of the prior art have been less than totally satisfactory since they typically have not indicated where the film break has occurred. Thus, the operator has had to search for the film break in the processor. During this search time, the wet photographic film can pile up in the dryer and be damaged. One such type of break indicator includes a magnet attached to a roller on the loading end of the machine, and a magnetic sensor positioned near the roller to sense the magnet as it passes with each revolution of the roller. As the photographic film is pulled off a loading reel, it engages and rotates the roller. If the magnet does not pass the magnetic sensor within a predetermined time, a film break is indicated by an alarm. This type of break indicator, however, does not tell the operator where in the entire processor the film has broken, only that a break has occurred.

SUMMARY OF THE INVENTION

A photographic film processor with a film dryer through which photographic film is transported and dried, includes film break detection system for detecting a photographic film break within the dryer and preventing the accumulation of wet photographic film therein. The break detection system includes first and second substantially horizontal shafts spaced from each other within the dryer. Both first and second shafts have rollers which movably engage the photographic film while it is being transported through the dryer under tension. The second shaft is movable with respect to the first shaft and is biased in a direction opposite to the direction of tensional forces applied to the second shaft by the photographic film. A sensor senses the change in the spatial position of the second shaft when a loss of film tension due to a photographic film break occurs, and provides a film break alarm signal.

In preferred embodiments of the present invention, the film break alarm signal causes the dryer transport system to shut down. In addition, the alarm signal actuates annunciator means to produce an alarm specifically indicating that the break has occurred in the dryer. The operator, knowing that the break has occurred in the dryer, has the option of either trying to splice the film immediately within the dryer, or pulling the film from the dryer into a tank of wash water until he is ready to reinitiate operation of the dryer.

DETAILED DESCRIPTION OF THE PREFERRED EMBODIMENTS

Figure 1:
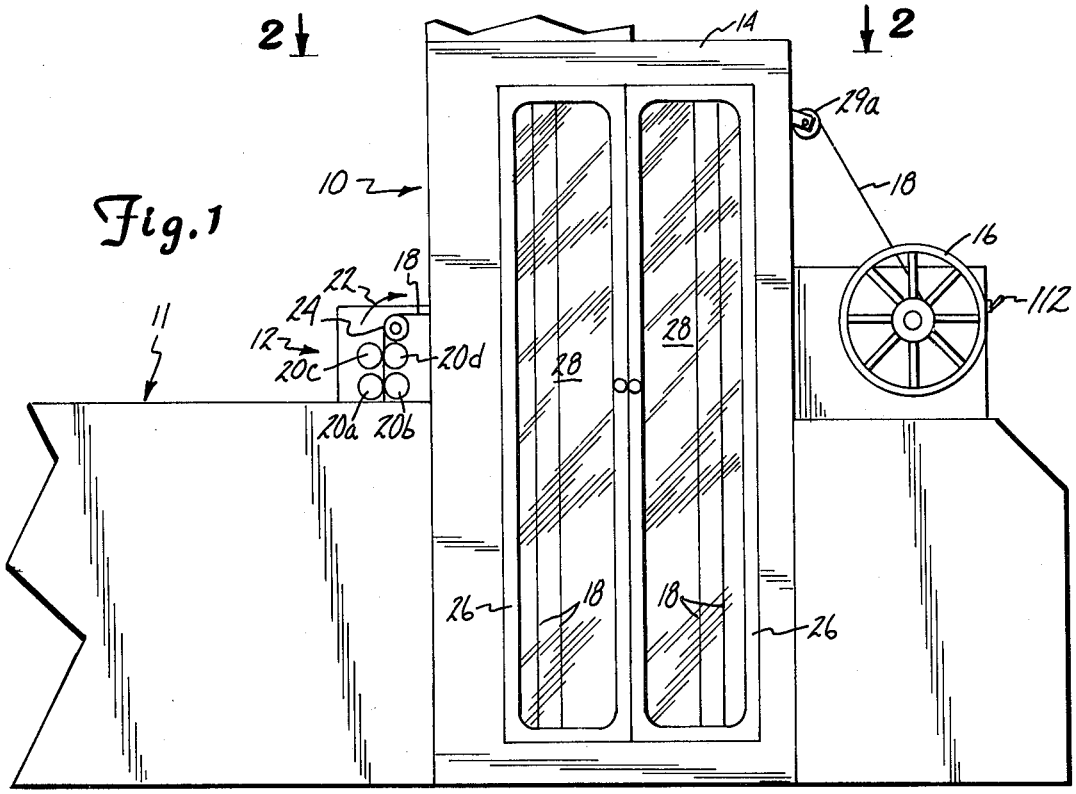
FIG. 1 is a front view of a dryer section of a photographic film processor.

In FIG. 1, a photographic film processor is illustrated having a dryer section 10 and a wet section 11. Dryer 10 includes buffer roll assembly 12, dryer chamber 14, and takeup reel 16. Photographic film 18 leaves the wet section 11 of the processor after being developed and washed, and enters dryer section 10 upon engaging buffer roll assembly 12.

Buffer roll assembly 12 includes a plurality of rollers 20*a*, 20*b*, 20*c* and 20*d*. Rollers 20*a* and 20*b* are in generally opposed relationship, as are rollers 20*c* and 20*d*, to squeeze film 18 between their respective contacting surfaces sufficiently hard to cleanse and remove excess solution from film 18, but lightly enough to allow film 18 to pass. Each roller 20*a*–20*d* rotates in direction opposite to the movement of film 18 (as shown by arrow 22) at the point of contact with film 18. The opposing rotation of each set of rollers 20*a*–20*b* and 20*c*–20*d* not only cleanses and removes excess solution from film 18, but also adds back tension to film 18 as it enters dryer chamber 14. Idler roller 24 guides film 18 into dryer chamber 14.

Film 18 is dried as it is transported through dryer chamber 14. As illustrated in FIG. 1, dryer chamber 14 preferably has doors 26 with transparent windows 28 which permit an operator to observe film 18 as it is transported through chamber 14.

After being dried by and exiting dryer chamber 14 film 18 is transported over accumulator 29 (shown in FIG. 2), over idler spool 29*a* and then onto takeup reel 16.

Figure 2:
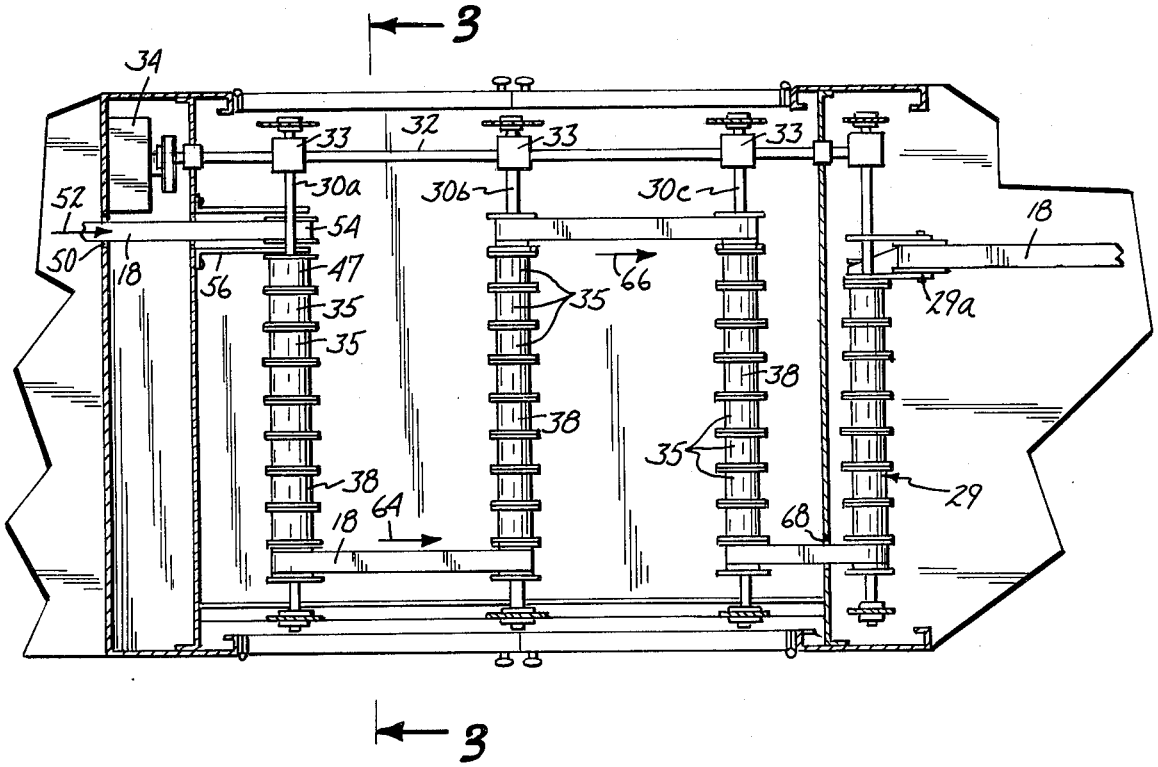
FIG. 2 is a sectional view of the dryer taken along section 2—2 in FIG. 1.
Figure 3:
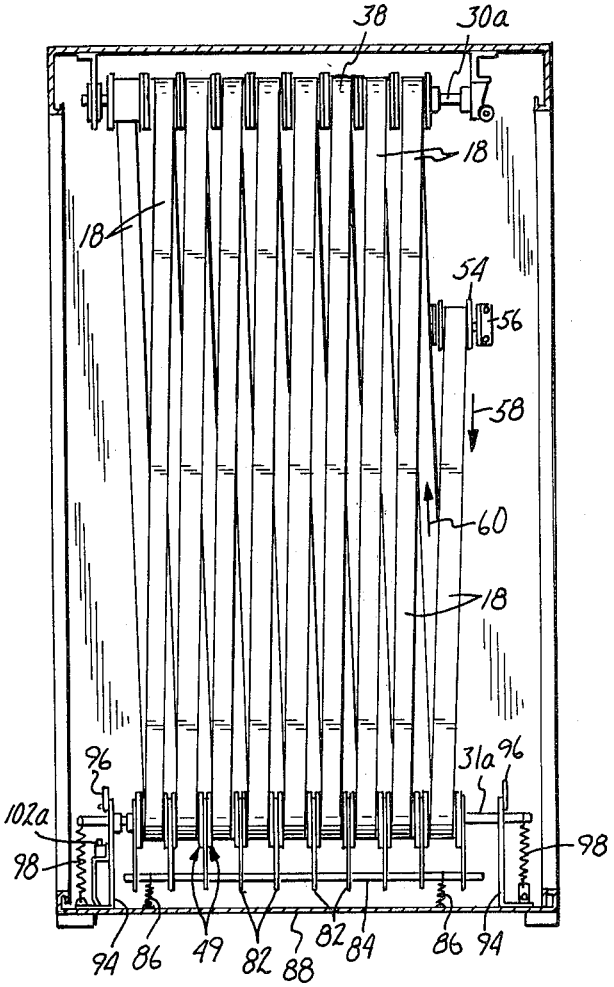
FIG. 3 is a cross-sectional view of the dryer taken along section 3—3 in FIG. 2.
Figure 8:
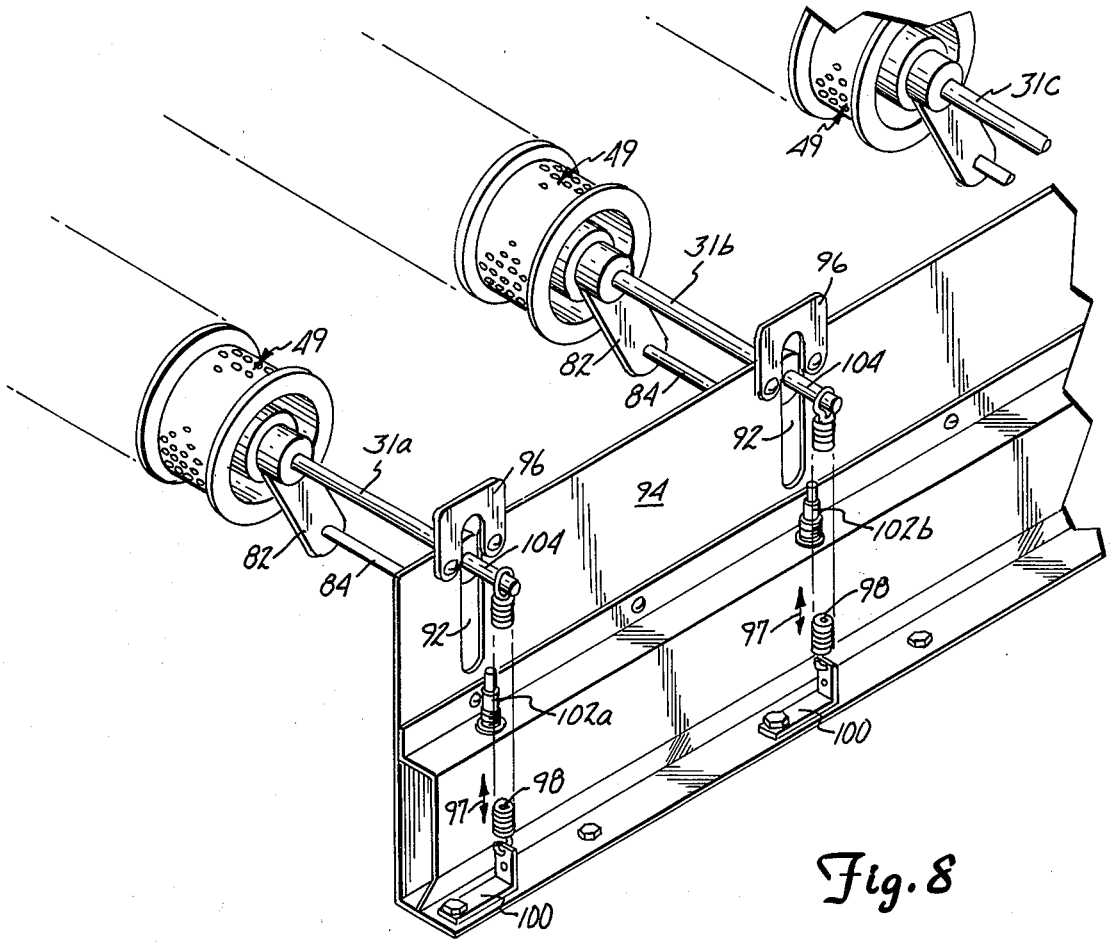
FIG. 8 is a perspective view of the film break sensor which senses the position of the lower shafts, and thus the film tension in the dryer.

FIGS. 2 and 3 show generally the manner in which photographic film 18 is transported through dryer chamber 14. Dryer chamber 14 preferably has a plurality of upper or first shafts 30*a*, 30*b* and 30*c* and a plurality of lower or second shafts 31*a*, 31*b* and 31*c*, as best seen in FIGS. 2 and 8. Each upper shaft 30*a*, 30*b* and 30*c* has a corresponding lower shaft 31*a*, 31*b* and 31*c* spaced below.

In the embodiment illustrated in the Figures, upper shafts 30*a*, 30*b* and 30*c* are all driven by a common drive shaft 32 through individual gear boxes 33. Drive shaft 32, in turn, is connected through gear box clutch assembly 34 to the drive system of wet section 11 of the photographic processor. Lower shafts 31*a*–31*c* are not driven in this particular embodiment.

Figure 4:
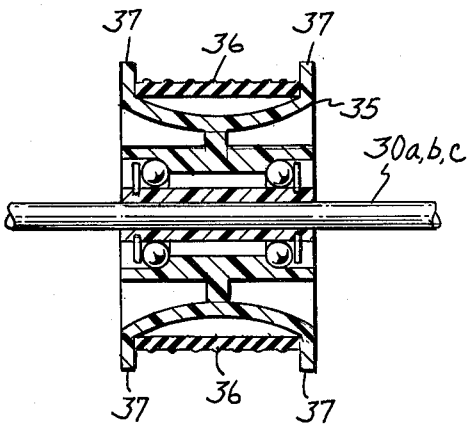
FIG. 4 is a cross-sectional view of an idler spool.

Mounted on upper shafts 30*a*–30*c* are a plurality of idler spools 35. Each idler spool 35 is a free spinning spool or roller with preferably a film engaging surface 36 that frictionally engages film 18, as best seen in FIG. 4. Spool 35 has edge portions 37 that contain film 18 within film engaging surface 36.

Figure 5:
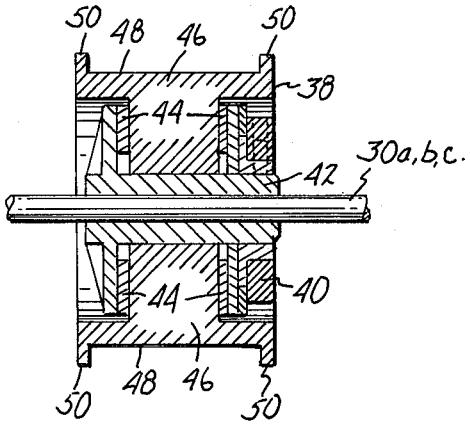
FIG. 5 is a cross-sectional view of a clutch roller.

In addition to idler spools 35, each upper shaft 30*a*–30*c* preferably has at least one clutch roller 38 mounted thereon. Clutch roller 38, as best seen in FIG. 5, has a nut 40 which threadably engages rod member 42 which in turn is fixedly attached to upper shaft 30*a* (or 30*b* or 30*c*). Spring washers 44 engage main body 46 of clutch roller assembly 38. Tightening nut 40 on shaft member 42 squeezes spring washers 44 on either side of main body 46 frictionally engaging and preventing it from freely rotating. Main body 46 has a film engaging surface 48 that engages photographic film 18. Clutch roller 38 also has edge portions 50 similar to edge portions 37 of idler spool 35 for the same purpose of containing film 18 on the film engaging surface 48. The clutch roller 38 imparts the tension to film 18 in the dryer chamber 14.

Shaft 30*a* is a pacer shaft with a pacer roller 47 fixedly keyed to the shaft 30*a*. The pacer roller 47 is preferably the first roller on the first upper shaft and sets the speed absolutely of film 18 through dryer chamber 14. The pacer roller 47 has a diameter such that a five percent underdrive of film 18 with respect to the drive system of wet section 11 occurs.

Clutch rollers 38 have a diameter approximately fifteen percent larger than the diameter of pacer roller 47. The larger diameters of clutch rollers 38 result in constant slip of the clutch rollers 38. The number of clutch rollers 38 located on upper shafts 30*a*, 30*b* and 30*c* is sufficient to keep the film under uniform tension throughout dryer chamber 14. The frictional settings of each clutch roller 38 impart tension into the film 18. Film tension can be adjusted by tightening or loosening nut 40, so that the frictional setting is increased or decreased.

Mounted on each of lower shafts 31*a*–31*c* are a plurality of idler spools 49. Lower shafts 31*a*–31*c* are not driven, and idler spools 49 freely rotate on shafts 31*a*–31*c*. In the preferred embodiments, idler spools 49 are of the same construction as idler spools 35.

Film 18 enters dryer chamber 14 through entrance opening 50 in a direction of arrow 52, as shown in FIGS. 2 and 3. Photographic film 18 preferably engages an initial idler roller 54 rotatably attached to a wall of dryer chamber 14 by bracket 56. Film 18 then proceeds in a direction of arrow 58 downwardly and under a first idler spool 49 on lower shaft 31*a*. Film 18 then proceeds upwardly toward upper shaft 30*a*, as indicated by arrow 60, to engage pacer roller 47 on upper shaft 30*a*. Film 18 proceeds back and forth between idler spools 35 (or clutch roller 38) on upper shaft 30*a* and idler rollers 49 on lower shaft 31*a* in a serpentine-like manner until all of idler spools 35, clutch roller(s) 38 and idler spools 49 are engaged by film 18.

Film 18 then proceeds in a direction of arrow 64 to a second set of upper and lower shafts 30*b* and 31*b*. (Upper shaft 30*b* is shown in FIG. 2; lower shaft 31*b* is not visible in FIG. 2 because it is below upper shaft 30*b*.) Film 18 engages the first idler spool 35 of upper shaft 30*b* of the second set after leaving the last idler spool 35 of upper shaft 30*a* of the first set, traveling in a substantially horizontal plane from one set of shafts to another. Film 18, after engaging idler spool 35 on upper shaft 30*b*, proceeds downward to the first idler spool 49 of the lower shaft 31*b*, in a similar manner as discussed above, and engages remaining idler spools 35 and clutch roller(s) 38 located on upper shaft 30*b* and idler spools 49 on lower shaft 31*b* in a serpentine-like manner.

The third set of shafts 30*c* and 31*c* are also threaded in a similar manner, film 18 proceeding in a direction shown by arrow 66 from lower shaft 31*b* (shown in FIG. 8) of the second set to lower shaft 31*c* (shown in FIG. 8) of the third set, and then engaging idler spools 35, clutch roller(s) 38 and idler spools 49 on shafts 30*c* and 31*c* of the third set in a serpentine-like manner.

In the preferred embodiment, as shown in FIG. 2, only three sets of upper and lower shafts are shown. However, any number of sets of shafts may be used. The number of sets of first and second shafts is determined by the speed of film 18 traveling through dryer chamber 14 and the amount of residence time needed within chamber 14. Thus, any number of first and second shaft sets are within the spirit and scope of the present invention. Similarly, although a vertical configuration is shown with lower shafts 31*a*–31*c* positioned below driven upper shafts 30*a*–30*c*, other relative positions of the shafts are possible, such as a horizontal spatial relationship between shafts 30*a*–30*c* and 31*a*–31*c*.

After completely traversing the serpentine path between shafts 30*c* and 31*c*, film 18 exits dryer chamber 14 through exit opening 68 and engages spools of accumulator 29. From accumulator 29, film 18 is taken up on takeup reel 16.

Figure 7:
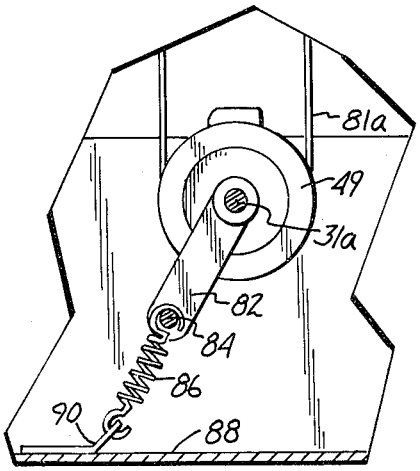
FIG. 7 is an enlarged cross-sectional view of the lower shaft.
Figure 6:
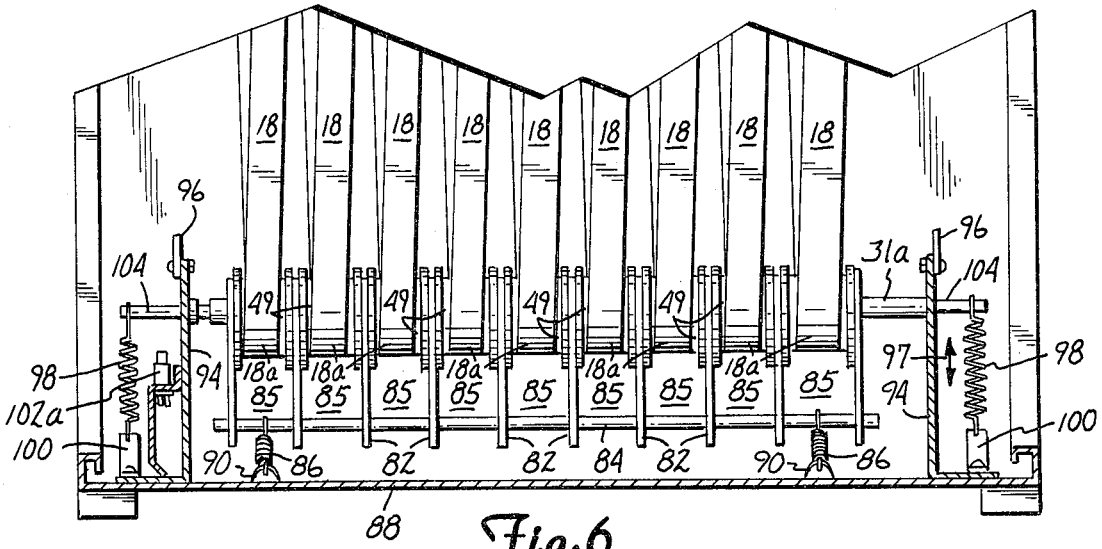
FIG. 6 is a fragmentary enlarged view of the bottom portion of the dryer of FIG. 3.

As best seen in FIG. 6, lower shafts 31*a*–31*c* each have a plurality of idler spools 49 which rotate freely, engaging film 18 in looped sections 18*a*. Adjacent to each idler spool 49 is preferably an elongated rigid member 82 that ensures the restriction of looped sections 18*a* within the boundary of corresponding individual idler spools 49. To further ensure the containment of looped sections 18*a*, a retaining rod 84 engages an aperture located in all elongated members 82, compartmentalizing each film loop 18*a* within each individual idler spool 49 in area 85. Retaining rod 84 and elongated member 82 are held in place preferably by coil springs 86, although any manner of retention may be used. Coil springs 86, as best seen in FIG. 7, are mounted to the floor 88 of dryer chamber 14 by engagement with bracket 90.

Lower shafts 31*a*–31*c* are suspended by film 18 and are vertically movable within slots 92 of lower dryer chamber shaft brackets 94. Shafts 31*a*–31*c* are contained within slots 92 by shaft bracket tabs 96. Shafts 31*a*–31*c* are biased in a direction that is opposite to the force applied to shafts 31*a*–31*c* by the film tension. In the preferred embodiment, the bias is in a downwardly direction as best indicated by arrows 97 in FIGS. 6 and 8. The film tension, caused by clutch rollers 38, is sufficient to suspend shafts 31*a*–31*c*. The film tension is adjusted by means of clutch rollers 38 and balanced against the bias (and gravity) such that lower shafts 31*a*–31*c* are suspended at a predetermined vertical height. Lower shafts 31*a*–31*c* are preferably biased by coil springs 98, which engage shaft portions 104 on both ends of shafts 31*a*–31*c* and are attached to the lower dryer chamber shaft brackets 94 by brackets 100.

In the present invention, shaft position sensors 102*a*–102*c*, which preferably are microswitches, sense the position of lower shafts 31*a*–31*c*, respectively. When a break in film 18 occurs in dryer chamber 14, first one of the lower shafts 31*a*–31*c* (and ultimately all of the lower shafts) will drop due to gravity and the bias force of springs 98. The shaft portions 104 which extend beyond lower dryer chamber shaft brackets 94 will engage sensors 102*a*–102*c* and cause the sensors to change state, thereby providing an alarm signal. In the preferred embodiment in FIGS. 6 and 8, lower shafts 31*a*–31*c* are preferably biased downwardly, but may be biased in any direction to retain film tension and the suspension of shafts 31*a*–31*c* depending on the particular arrangement of shafts 30*a*–30*c* and shafts 31*a*–31*c* within dryer chamber 14.

Figure 9:
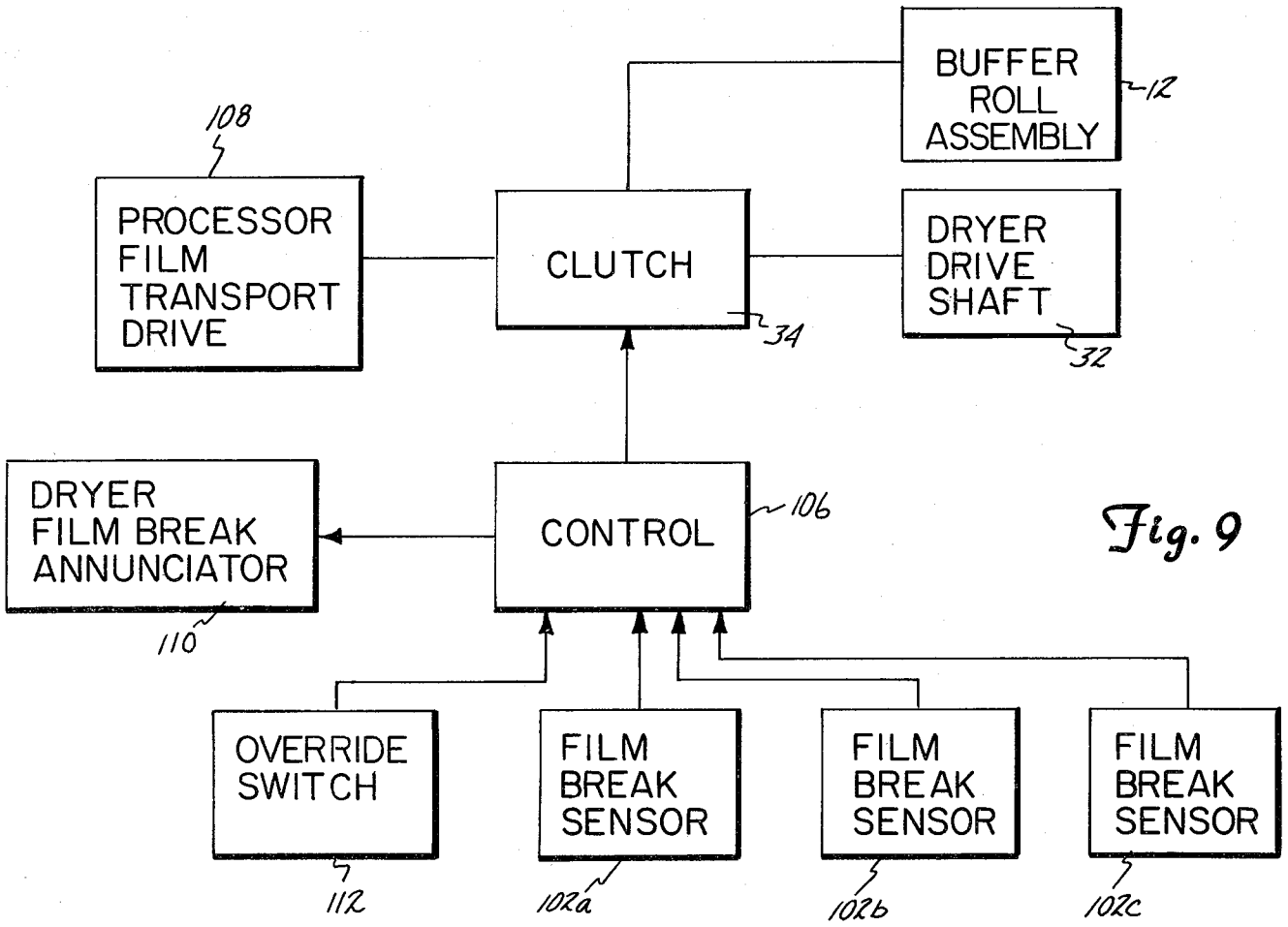
FIG. 9 is an electrical block diagram of the film break detection system.

When photographic film 18 is threaded through dryer chamber 14 and clutch rollers 38 on upper shafts 30*a*–30*c* have been tightened to produce the proper frictional force as discussed previously, the tension in film 18 will be sufficient to lift lower shafts 31*a*–31*c* along slots 92 above sensors 102*a*–102*c*. Thus, during normal operation of dryer 10 there is enough tension in photographic film 18 to keep the lower shafts 31*a*–31*c* from engaging the sensors 102*a*–102*c*, respectively. However, if film 18 breaks within dryer chamber 14 (e.g. due to a poor splice between individual customer film sections or due to breaks due to nicks in the film 18), tension is lost and a shaft portion 104 drops due to gravity and spring bias against sensor 102*a* (or 102*b* or 102*c*). When one of the sensors 102*a*–102*c* is engaged by a shaft portion 104 and produces an alarm signal, control 106 causes clutch 34 to disengage drive shaft 32 from the drive system of the remainder of the film processor drive 108, diagramatically shown in FIG. 9. The disengagement of drive shaft 32 in the dryer section stops any accumulation of wet film 18 in dryer chamber 14, thereby eliminating wet film sections from sticking to each other and ruining the images thereon. The retaining rod 84 and elongated members 82 also provide help during a film break by retaining individual film loops 18*a* within compartmentalized area 85 created by elongated members 82 and retaining rod 84. The control 106 also causes buffer roller assembly 12 to be disengaged and stopped, holding film 18 stationary due to its squeezing engagement of film 18.

In response to an alarm signal, control 106 activates an annunciator 110 such as a buzzer which produces a unique audible or visual alarm which warns the operator that a break has occurred within dryer chamber 14. This annunciator alarm is different and distinguishable from the alarm produced by the film break detector located at the loading end of the processor. The present invention significantly reduces the time required by the operator to locate the film break, since the operator knows that the film break has occurred in the dryer due to the unique annunciator alarm 110 and stoppage of the dryer drive system. Given the extra time saved in locating the break, the operator may look quickly at the break by opening doors 26 of dryer chamber 14 and either try to splice film 18 immediately or pull the broken film 18 from the dryer section through entrance opening 50 and into a wash water tank of wet section 11. If the first option is chosen and the break is immediately spliced within dryer chamber 14, override switch 112 is activated, causing clutch 34 to reengage dryer drive shaft 32 with the rest of film processor drive system. The option of splicing within dryer chamber 14 is available since dryer drive shaft 32 is stopped and the operator is given the additional time by the immediate warning that the break has occurred in the dryer. If the other option is chosen, the film is then rethreaded through dryer chamber 14 and onto a new takeup reel 16.

Conclusion

The break detection system of the present invention, by sensing the spatial position of movable shafts 31*a*–31*c*, and thus the tension of photographic film 18 being transported through dryer chamber 14, immediately warns the operator by an alarm that the break has occurred within the dryer chamber 14. The system also disconnects the drive system of dryer section 10, stopping wet film accumulation within dryer chamber 14.

The tension in photographic film 18 is carefully balanced between clutch rollers 38 and biasing spring 98 in order to allow lower shafts 31*a*–31*c* to be suspended in a position spaced from shaft position sensors 102*a*–102*c*. When a break occurs, the loss of film tension causes lower shaft 31*a*–31*c* to fall and engage its respective sensor 102*a*–102*c*, which provides an alarm signal which warns the operator and stops the dryer drive.

Although the present invention has been described with reference to the preferred embodiment, persons skilled in the art will recognize that changes may be made in form and detail without departing from the spirit and scope of the invention.

What is claimed is:

1. In combination with a photographic film dryer through which a photographic film web is transported under tension and dried, a film break detection system for detecting photographic film breaks within the dryer, the break detection system comprising:

first and second substantially horizontal shaft means in a spaced relationship wherein the photographic film web traverses a serpentine path between the first and second shaft means, the second shaft means being spatially movable with respect to the first shaft means wherein the first shaft means includes a plurality of first shafts all approximately at the same vertical position and wherein the second shaft means includes a plurality of second shafts all at approximately the same vertical position, each second shaft being located below a corresponding first shaft;

roller means on the first and second shaft means movably engaging the photographic film web as the web traverses the serpentine path between the first and second shaft means;

biasing means for applying a bias force to each second shaft in a direction opposite to a force applied to the second shaft by the film tension, thereby suspending the second shaft with respect to the corresponding first shaft; and means for sensing a change of spatial position of the second shaft as a result of a film break and providing an alarm signal indicating that the film break occurred in the dryer, the means for sensing a change of spatial position being positioned within the dryer and wherein the means for sensing includes a plurality of switch means and each second shaft being positioned with a corresponding switch means such that when the film break has occurred, an individual second shaft physically engages the corresponding switch means to indicate that the film break occurred in the dryer.

2. The break detection system of claim 1 wherein the roller means comprises a plurality of adjacent spools rotatably attached to each first and second shafts for movably engaging the photographic film.

3. The break detection system of claim 1 and further comprising clutch means mounted on the first shaft means for providing a force in a direction with the movement of the photographic film thereby opposing the biasing force and increasing the tension in the photographic film web within the dryer.

4. The break detection system of claim 3 wherein the clutch means is an adjustable clutch means providing an adjustable tension control of the photographic film.

5. The break detection system of claim 1 wherein biasing means for biasing each second shaft is spring means having one end attached to the second shaft and another end attached to a fixed section of the dryer.

6. The break detection system of claim 1 wherein the second shaft activates an alarm signal when a break in the photographic film occurs through engagement with the switch means.

7. The break detection system of claim 6 and further comprising:

drive means for driving the first shafts; and means for operably disconnecting the drive means from the first shafts in response to the alarm signal.

8. The break detection system of claim 6 and further comprising an annunciator means turned on in response to the alarm signal.

9. In a photographic film processor having a wet section for developing, fixing and washing a photographic film web and dryer for drying the film web, first film transport means for transporting the film through the wet section, second film transport means for transporting the film web received from the wet section under tension through the dryer, the improvement comprising:

means for sensing a parameter which is a function of film tension and positioned within the dryer and providing an alarm signal that indicates the break occurred in the dryer when the parameter is indicative of a film break in the dryer.

10. The improvement of claim 9 wherein the parameter comprises a spatial position of a member which is movable as a function of film tension.

* * * * *

UNITED STATES PATENT OFFICE

CERTIFICATE OF CORRECTION

Patent No. 4,344,073 Dated August 10, 1982

Inventor(s) Robert M. Rawlings

It is certified that error appears in the above-identified patent and that said Letters Patent are hereby corrected as shown below:

First page, after "[73] Assignee:", delete "Padco, Inc.", and insert therefor --Pako Corporation-- .

Signed and Sealed this

Seventh Day of January 1986

[SEAL]

Attest:

DONALD J. QUIGG

Attesting Officer

Commissioner of Patents and Trademarks